US009797252B2

(12) United States Patent
Stein et al.

(10) Patent No.: US 9,797,252 B2
(45) Date of Patent: Oct. 24, 2017

(54) FLUID WORKING MACHINE WITH VALVE ACTUATOR AND METHOD FOR CONTROLLING THE SAME

(75) Inventors: Uwe Stein, Lothian (GB); Fergus McIntyre, Lothian (GB); Jens Eilers, Lothian (GB); Gordon Voller, Lothian (GB)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 993 days.

(21) Appl. No.: 13/703,771

(22) PCT Filed: Feb. 9, 2012

(86) PCT No.: PCT/JP2012/000866
§ 371 (c)(1),
(2), (4) Date: Feb. 21, 2013

(87) PCT Pub. No.: WO2013/118181
PCT Pub. Date: Aug. 15, 2013

(65) Prior Publication Data
US 2013/0213212 A1 Aug. 22, 2013

(51) Int. Cl.
*F01B 17/00* (2006.01)
*F04B 39/10* (2006.01)
*F04B 49/06* (2006.01)

(52) U.S. Cl.
CPC ..... *F01B 17/00* (2013.01); *F04B 39/10* (2013.01); *F04B 49/065* (2013.01)

(58) Field of Classification Search
CPC ..... F04B 49/065; F04B 39/10; F04B 35/045
(Continued)

(56) References Cited

U.S. PATENT DOCUMENTS 2,496,553 A * 2/1950 Littlefield ..... F16K 31/408 137/595
3,232,674 A * 2/1966 Stelzer ..... B60T 8/1887 137/102
(Continued)

FOREIGN PATENT DOCUMENTS

CN 102348919 A 2/2012
EP 0 361 927 A1 4/1990
(Continued)

OTHER PUBLICATIONS

PCT, "International Preliminary Report on Patentability for PCT/JP2012/000866."
(Continued)

*Primary Examiner* — Michael R. Reid
*Assistant Examiner* — Patrick Williams
(74) *Attorney, Agent, or Firm* — Manabu Kanesaka; Benjamin Hauptman; Kenneth Berner

(57) ABSTRACT

A fluid working machine has at least one working chamber of cyclically varying volume and low and high pressure valves to regulate the flow of working fluid into and out of the working chamber, from low and high pressure manifolds. The low and high pressure valves are actuated by electronically controlled valve actuation means which, when actuated, applies forces to the low and high pressure valve members to open and/or close the respective valves. The low and high pressure valve members are independently moveable and, although the low pressure valve member typically begins to move quickly in response to a shared valve control signal, the high pressure valve member typically moves only after a change in the pressure within the working chamber. The electronically controlled valve actuation means may be a shared electronically controlled valve actuator, such as a solenoid within a magnetic circuit which directs magnetic flux through both low pressure and high pressure valve
(Continued)

armatures which are connected to the respective valve members.

17 Claims, 8 Drawing Sheets

(58) Field of Classification Search
USPC ..... 137/596.14, 596.16, 595
See application file for complete search history.

(56) References Cited

U.S. PATENT DOCUMENTS

| | | | | |
|---|---|---|---|---|
| 3,472,277 | A * | 10/1969 | Reinicke | F16K 31/0665 137/595 |
| 4,706,932 | A * | 11/1987 | Yoshida | F15B 13/0405 137/596.16 |
| 5,190,446 | A | 3/1993 | Salter et al. | |
| 5,259,738 | A | 11/1993 | Salter et al. | |
| 6,162,026 | A * | 12/2000 | Kimura | F04B 27/1804 417/222.2 |
| 2006/0147329 | A1 | 7/2006 | Tanner | |
| 2007/0086899 | A1 | 4/2007 | Sommars et al. | |
| 2010/0243927 | A1* | 9/2010 | Wahlefeld | F15B 11/006 251/57 |
| 2011/0226342 | A1 | 9/2011 | Stein et al. | |
| 2011/0268590 | A1 | 11/2011 | Stein et al. | |
| 2012/0000554 | A1 | 1/2012 | Mcintyre et al. | |
| 2012/0023918 | A1 | 2/2012 | Laird et al. | |
| 2012/0042771 | A1 | 2/2012 | Mcintyre et al. | |

FOREIGN PATENT DOCUMENTS

| | | | |
|---|---|---|---|
| EP | 0 494 236 | A1 | 7/1992 |
| EP | 0 494 236 | B1 | 7/1992 |
| EP | 1 429 020 | A1 | 6/2004 |
| EP | 2 239 463 | A1 | 10/2010 |
| EP | 2 322 802 | A1 | 5/2011 |
| JP | S52-103706 | A | 8/1977 |
| JP | 2008-527232 | A | 7/2008 |
| WO | WO 2009/153605 | A1 | 12/2009 |

OTHER PUBLICATIONS

China Patent Office, "Notice of Allowance for CN 201280002193.3," dated Dec. 29, 2015.

Europe Patent Office, "Notice of Allowance for EP 12706117.4," dated Jan. 8, 2016.

PCT, "International Search Report for International Application No. PCT/JP2012/000866", dated Jun. 1, 2012.

Japan Patent Office, "Decision to grant a patent for JP 2013-504994," dated Apr. 1, 2014.

China Patent Office, "Office Action for CN 201280002193.3," dated Mar. 27, 2015.

* cited by examiner

[Fig. 1]
PRIOR ART
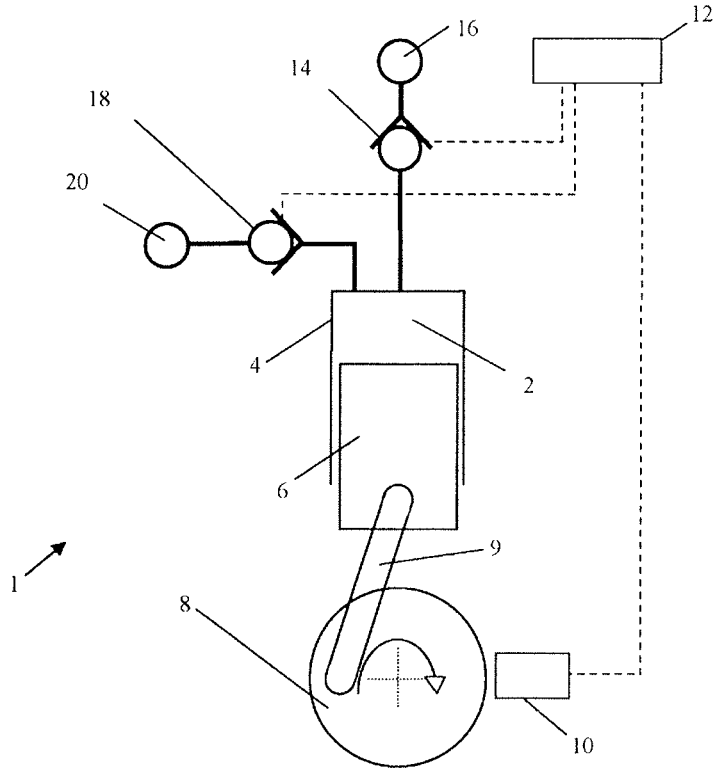

[Fig. 2]
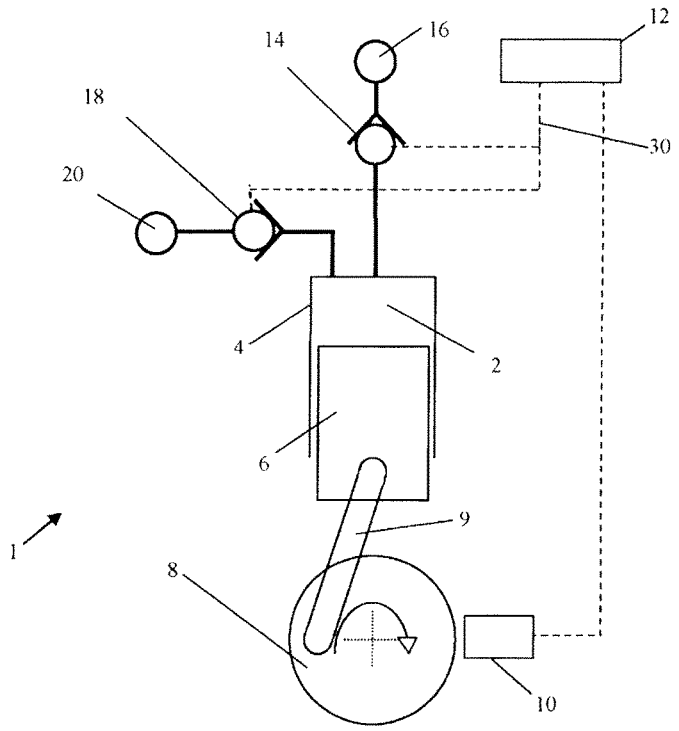
[Fig. 3]
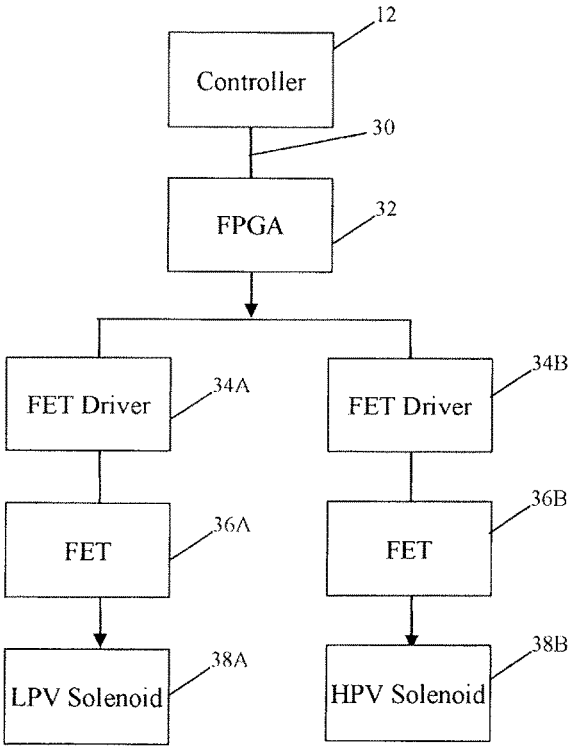

[Fig. 4]
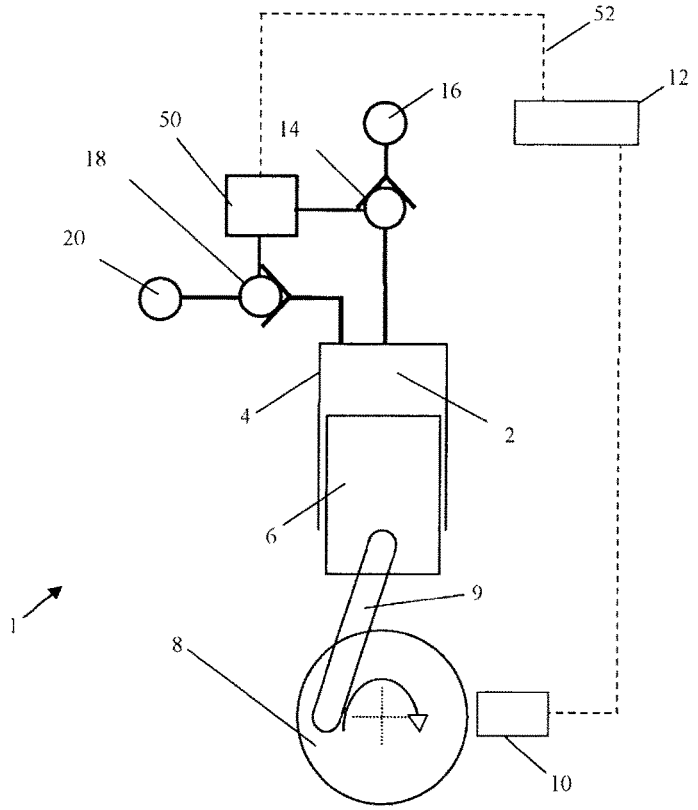
[Fig. 5]
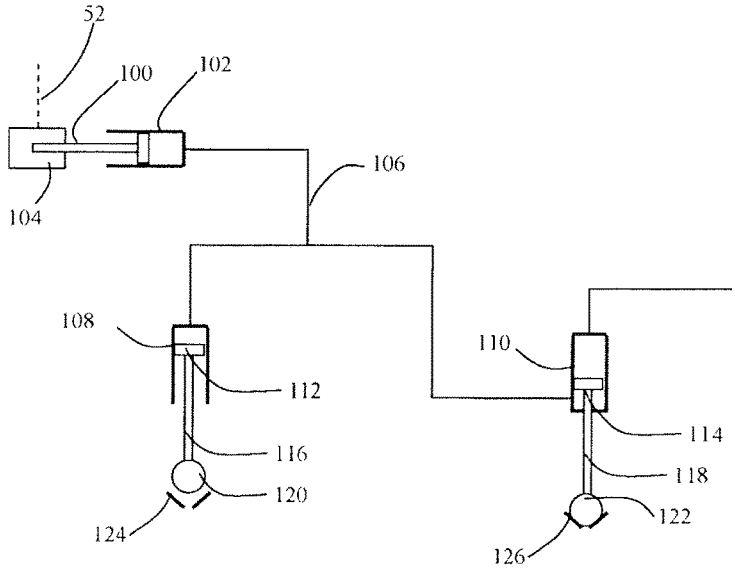

[Fig. 6A]
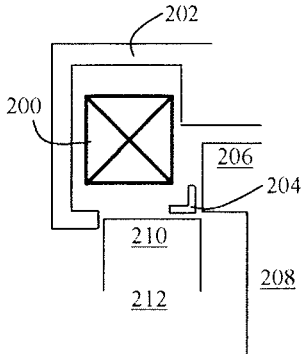
[Fig. 6B]
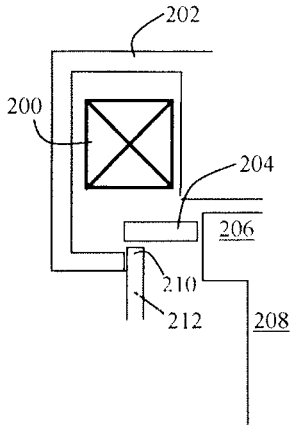
[Fig. 6C]
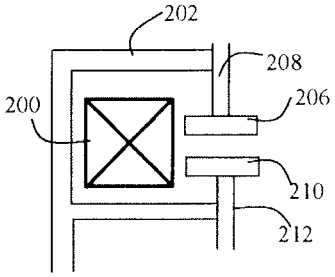

[Fig. 7]
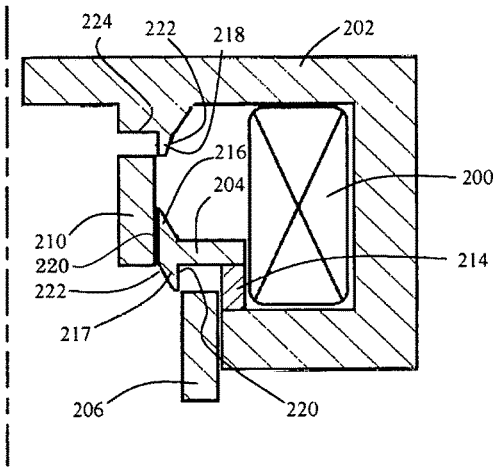
[Fig. 8]
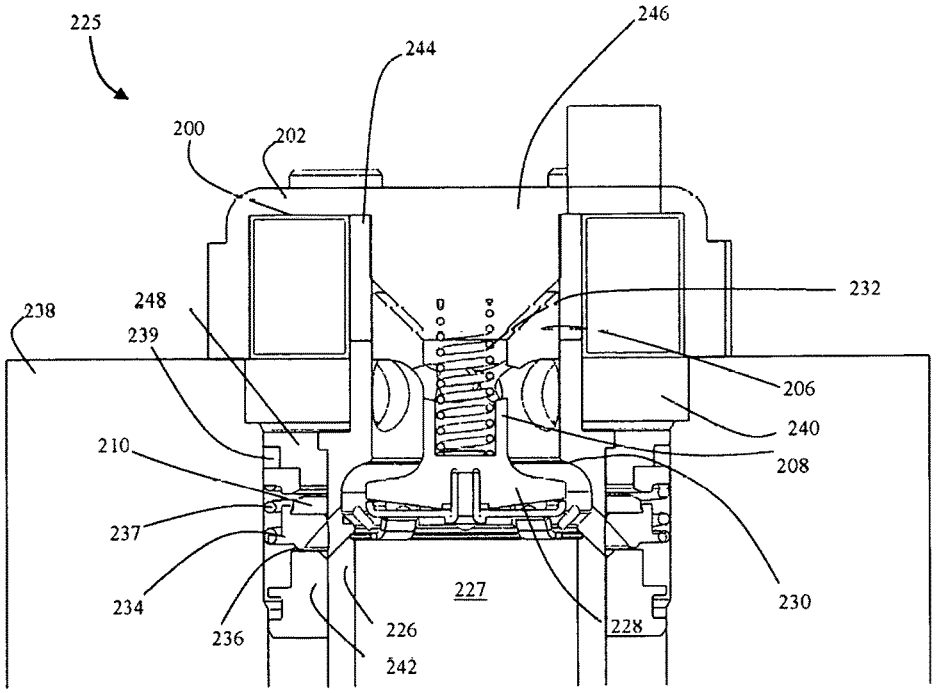

[Fig. 9A]
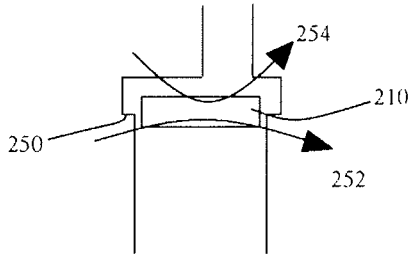
[Fig. 9B]
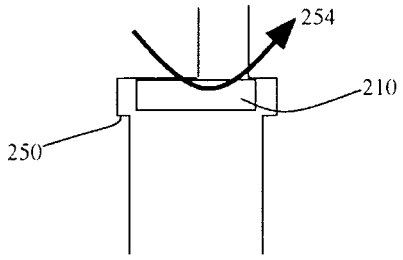

[Fig. 10]
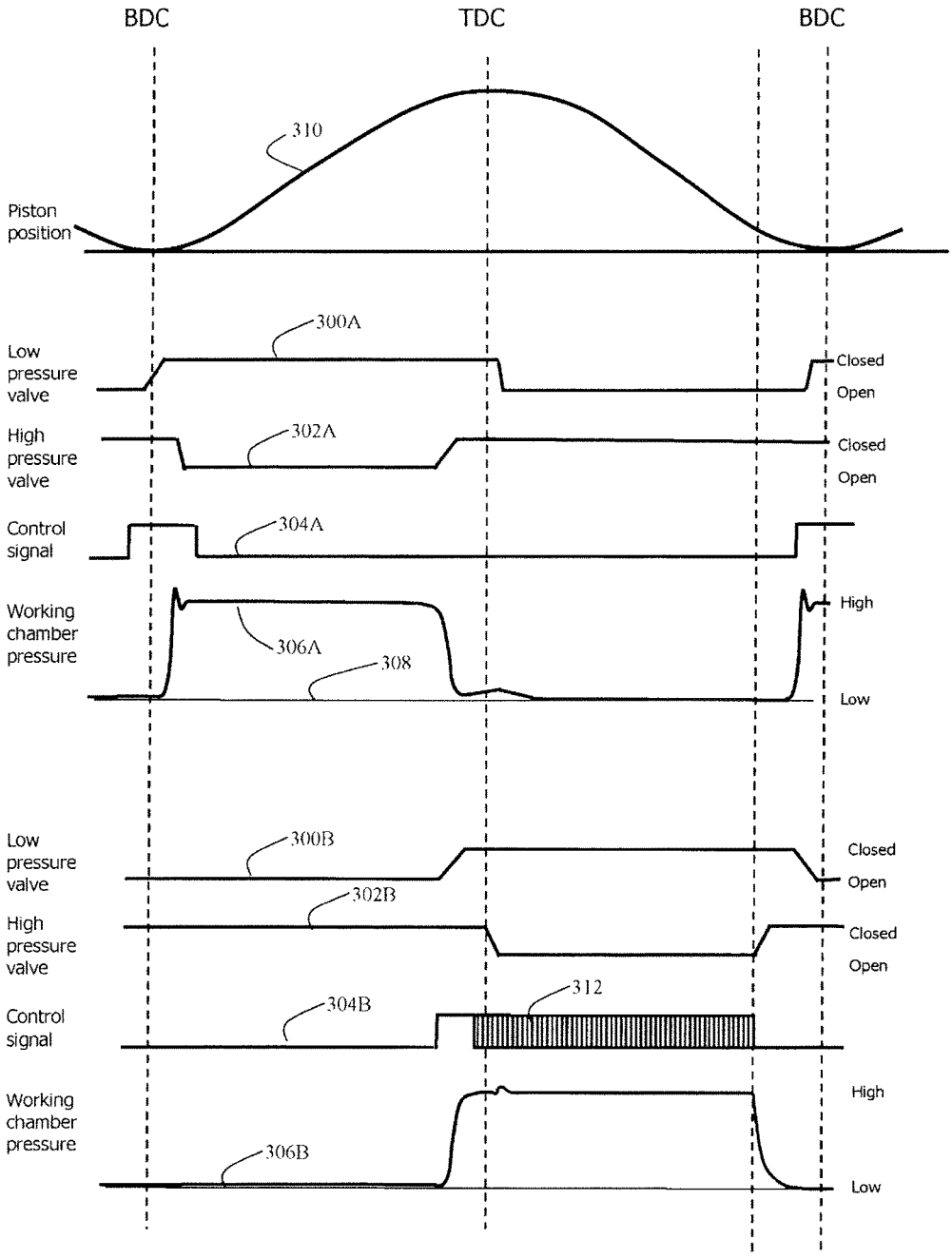

[Fig. 11A]
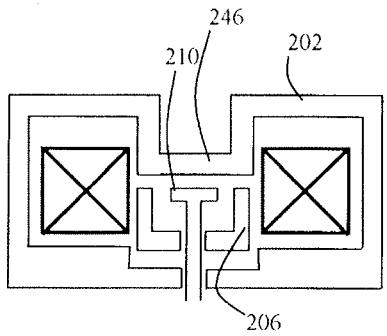
[Fig. 11B]
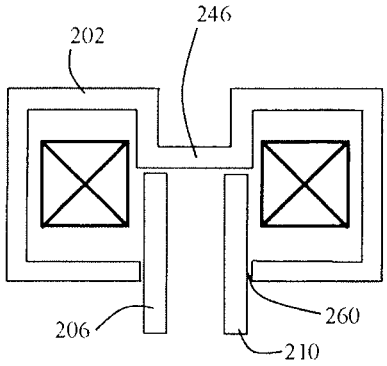

FLUID WORKING MACHINE WITH VALVE ACTUATOR AND METHOD FOR CONTROLLING THE SAME

RELATED APPLICATIONS

The present application is National Phase of International Application No. PCT/JP2012/000866 filed Feb. 9, 2012.

TECHNICAL FIELD

The invention relates to the field of fluid working machines in which the displacement of each working chamber is selectable on each cycle of working chamber volume by the active control of low and high pressure valves. The invention relates to the control of the actuation of the low and high pressure valves.

BACKGROUND ART

It is known in the art to provide fluid working machines in which the flow of working fluid into and out of a working chamber of cyclically varying volume is controlled on each cycle of working chamber volume by actively controlling the opening or closing of at least one electronically controlled valve, to select the net displacement of working fluid by the working chamber on each cycle of working chamber volume. This is known, for example, from EP 0361927 in which a low pressure valve which regulates the flow of working fluid between a working chamber and a low pressure manifold is actively controlled to enable a pump to carry out either an active cycle or an idle cycle. EP 0494236 developed this concept and introduced an actively controlled high pressure valve which regulates the flow of working fluid between a working chamber and a high pressure manifold, enabling a motor to carry out either an active cycle or an idle cycle and also enabling a fluid working machine to carry out either pumping or motoring cycles.

In each case, the LPV is actively controlled to select between active and idle cycles, and in some embodiments to control the fraction of maximum stroke volume which is displaced during active cycles. In order to enable active control, each valve has a respective solenoid which is coupled to a valve member.

The HPV is also typically actively controlled although in the case of a pump, the HPV can be operated in a solely passive way, for example, it may be a normally closed, pressure openable check valve. By active control we include the possibility of a valve being actively opened, actively closed, actively held open or actively held closed. An actively controlled valve may also move passively in some circumstances. For example, a LPV may be actively closed but open passively when the pressure in a cylinder drops below the pressure in the low pressure manifold.

Machines of this type have several advantages, including energy efficiency, an ability to rapidly respond to changes in demand, and a compact size. Although these machines have proven highly effective, to further develop them it would be advantageous to further simplify the control mechanism and to further reduce the bulk and complexity of the valve actuator mechanisms.

Accordingly, the invention seeks to provide a valve actuation mechanism which is simpler, smaller and/or more reliable than known valve actuation mechanisms for machines of this type.

SUMMARY OF INVENTION

According to a first aspect of the present invention there is provided a fluid working machine comprising at least one working chamber of cyclically varying volume, a low pressure fluid line, a high pressure fluid line, a low pressure valve for regulating the flow of fluid between the working chamber and the low pressure fluid line, a high pressure valve for regulating the flow of fluid between the working chamber and the high pressure fluid line, the low and high pressure valves being selectively actuatable on each cycle of working chamber volume to determine the net displacement of working fluid by the working chamber, the low pressure valve comprising a low pressure valve member, the high pressure valve comprising a high pressure valve member, the low pressure valve member and the high pressure valve member being independently movable between open and closed positions, wherein the fluid working machine further comprises electronically controlled valve actuation means (such as one or more electronically controlled valve actuators) configured to both cause an opening or closing force to be applied to the low pressure valve member and to cause an opening or closing force to be applied to the high pressure valve member responsive to a shared value actuation signal.

Thus, the low pressure valve member and the high pressure valve member are both subjected to valve opening or closing forces responsive to a shared valve actuation signal, rather than individual valve actuation signals for each of the low pressure valve and the high pressure valve.

However, each of the low pressure valve member and the high pressure valve member are independently movable between open and closed positions. Therefore, despite the use of a shared valve actuation signal, the low and high pressure valve members can be opened or closed at different times, enabling efficient operation of the fluid working machine.

The invention simplifies the control arrangements for the low and high pressure valves, improves reliability, and reduces cost.

Typically, the fluid working machine comprises a controller which determines whether the working chamber undergoes an active cycle or idle cycle on each cycle of working chamber volume by determining whether or not to actuate the electronically controlled valve actuation means by generating the shared valve actuation signal. The controller may also regulate the timing of the opening or closing of either or both the low pressure valve and the high pressure valve, for example by selecting the phase of the shared valve actuation signal relative to cycles of working chamber volume. The fluid working machine typically comprises a rotating shaft coupled to cycles of working chamber volume and a shaft position sensor which measures the position of the rotating shaft to enable the phase of the shared valve actuation signal relative to cycles of working chamber volume to be controlled.

Preferably, the electronically controlled valve actuation means causes said opening or closing forces to be applied to the low pressure valve member and the high pressure valve member at the same time but they open or close at different times in dependence on other factors such as changes in the pressure in the working chamber and the low and high pressure fluid lines respectively, forces arising from the flow of working fluid etc.

For example, in an example embodiment, the low pressure valve is biased towards the open position by one or more biasing members and the high pressure valve is biased towards the closed position by one or more biasing members. When the low pressure valve is closed (responsive to actuation of the electronically controlled actuator) there are also forces acting to close the low pressure valve arising from the flow of working fluid past the low pressure valve.

When the high pressure valve is opened (responsive to actuation of the electronically controlled actuator) it is necessary for the working chamber pressure to be almost as high as, or higher than, the high pressure manifold pressure, depending on the strength of the forces exerted by the one or more high pressure valve biasing members, and forces arising from the flow of working fluid also act to urge the high pressure valve member open or closed. Closing forces my also act on the high pressure valve member due to the Bernoulli effect. Thus, there is typically a time difference between the opening or closing of the low pressure valve and the opening or closing of the high pressure valve even though said opening or closing forces are applied concurrently (and typically at the same time).

For example, in a pumping cycle, the electronically controlled valve actuation means causes forces to be applied to the respective valve members associated with a working chamber to close the low pressure valve (to move the low pressure valve member to the closed position) and to open the high pressure valve (to move the high pressure valve member to the open position). The low pressure valve will then close straight away. Although the combined forces acting on the high pressure valve member arising from the actuation means and any resilient biasing then act such as to urge the high pressure valve open, it will not open immediately but instead after a short delay, only once sufficient pressure has built up in the contracting working chamber to enable the high pressure valve to open.

In a motoring cycle, in response to the shared valve actuation signal, forces may be applied to bias the low pressure valve closed and the high pressure valve open shortly before top dead centre. The low pressure valve closes quickly but the high pressure valve does not open until sufficient pressure has built up in the contracting working chamber. Before bottom dead centre, forces may be applied to urge the high pressure valve to close and the low pressure valve to open. The high pressure valve will close quickly but the low pressure valve will open after a delay, only once the pressure in the working chamber is sufficiently low as a result of expansion of the now sealed working chamber.

It may be that the low pressure valve comprises one or more low pressure valve biasing members (which are typically resilient members) which bias the low pressure valve member to an open position, and the high pressure valve comprises one or more high pressure valve biasing members (which are typically resilient members) which bias the high pressure valve member to a closed position. It may be that the low pressure valve comprises one or more low pressure valve biasing members which bias the low pressure valve member to a closed position, and the high pressure valve comprises one or more high pressure valve biasing members which bias the high pressure valve member to an open position. It may be that the low pressure valve comprises one or more low pressure valve biasing members which bias the low pressure valve member to a closed position and the high pressure valve comprises one or more high pressure valve biasing members which bias the high pressure valve member to a closed position. It may be that the low pressure valve comprises one or more low pressure valve biasing members which bias the low pressure valve member to an open position and the high pressure valve comprises one or more high pressure valve biasing members which bias the high pressure valve member to an open position.

It is conceivable that said opening or closing forces act in the same sense as the net biasing forces applied to the low pressure and high pressure valve by the one or more low pressure and high pressure valve biasing members, respectively.

However, preferably the forces caused by the electronically controlled valve actuation means oppose the net biasing forces of the one or more low pressure and high pressure valve biasing members. Typically, the forces caused by the electronically controlled valve actuation means oppose and exceed the net biasing forces applied to the low pressure and high pressure valve members by the one or more low pressure and high pressure valve biasing members.

Typically, the low pressure valve comprises one or more low pressure valve biasing members which bias the low pressure valve member to an open position, the high pressure valve comprises one or more high pressure valve biasing members which bias the high pressure valve member to a closed position, and said forces caused by the electronically controlled valve actuation means oppose the biasing forces of the low pressure and high pressure valve biasing members.

It may be that the low pressure valve member is biased either to the open position or the closed position by one or more said low pressure biasing members and the high pressure valve member is biased either to the open position or the closed position by one or more said high pressure biasing members, and said opening or closing forces change the sense of the net biasing applied to the low pressure and/or high pressure valve members. Thus, although one or more of the valve members may not open immediately due to other forces (e.g. forces arising from a pressure difference across the valve member, drag forces arising from the effect of flowing working fluid on the valve member etc.) the combined forces arising from the electronically controlled valve actuation means and any resilient biasing urge the low pressure and high pressure valves would cause the low pressure valve and/or high pressure valve to move were it not for any other forces.

It may be that the at least one or each electronically controlled valve actuator applies said opening or closing forces to the low pressure valve member and the high pressure valve member. It may be that the at least one or each electronically controlled valve actuator actuates one or more further actuators which apply said opening or closing forces.

Typically, the electronically controlled valve actuation means comprises a plurality of electronically controlled valve actuators, for example a plurality of solenoids. In that case, it may be that a first electronically controlled valve actuator is coupled to the low pressure valve member, and a second electronically controlled valve actuator is coupled to the high pressure valve member. It may be that the first and second electronically controlled valve actuators are solenoids. The low pressure valve may comprise the first solenoid, and an armature coupled to the low pressure valve member, and a magnetic circuit configured to direct flux generated by the first solenoid through the low pressure valve armature to actuate the low-pressure valve member. The high pressure valve may comprise a second solenoid, a high pressure valve armature coupled to the high pressure valve member, and a magnetic circuit configured to direct magnetic flux generated by the second solenoid through said high pressure valve armatures to actuate the second solenoid.

The first and second electronically controlled valve actuators (e.g., solenoids) may be controlled in parallel or in series. In one embodiment, the shared valve actuation signal takes the form of a current which is passed through the first and second solenoids in parallel or in series. In another embodiment, the shared valve actuation signal is a digital signal and a circuit is provided to generate a current to pass through both solenoids or a separate current for each solenoid. In some embodiments, the electronically controlled valve actuation means consists or comprises a shared electronically controlled valve actuator, which is coupled to both the low and high pressure valves (typically the low and high pressure valve members), and which causes said opening or closing forces to be applied to the low and high pressure valve members responsive to the shared valve actuation signal.

In some embodiments, the shared electronically controlled valve actuator comprises an actuated element (for example, an armature) which is moved when the electronically controlled valve actuator is actuated (for example, by a solenoid through which an activation current is passed) and the forces applied to the low pressure valve member and the high pressure valve member are coupled to movement of the actuated element (for example, through a mechanical, pneumatic or hydraulic coupling).

It may be that the shared electronically controlled valve actuator is a hydraulic or pneumatic or mechanical actuator, and the low and high pressure valve members are each driven by hydraulic or pneumatic or mechanical actuators respectively which are hydraulically or pneumatically or mechanically coupled as appropriate to the electronically controlled valve actuator.

It may be that the shared electronically controlled valve actuator comprises a solenoid and the low pressure valve member and the high pressure valve member are each coupled to a respective armature and both armatures are driven by the same solenoid.

The mean current applied to the shared solenoid may be switched between two values (one of which is typically zero) or may take a range of values depending on a valve actuation signal.

The fluid working machine may comprise a magnetic circuit extending through the solenoid and configured to direct magnetic flux through both armatures.

The magnetic circuit may be configured to direct magnetic flux through both armatures in series. The magnetic circuit may comprise a major portion which forms the majority of the magnetic circuit and which directs flux between the armatures and a minor portion which extends between the low pressure valve armature and the high pressure valve armature.

However, it may be that the magnetic circuit is configured to direct magnetic flux through both armatures in parallel. It may be that the magnetic circuit is configured to increase the reluctance of a magnetic circuit path through one of the low pressure valve armature and the high pressure valve armature when the respective armature moves. This helps to increase the magnetic flux through the other of the low pressure valve armature and the high pressure valve armature.

Preferably, the magnetic circuit comprises an end stop portion which defines the axial limit of movement of a said armature (the low pressure valve armature or the high pressure valve armature) and a protrusion (which can take the form of a step) extending radially towards said armature, axially spaced from the end stop portion, such that when the armature is in an initial position, axially spaced from the end stop portion (e.g. when the low pressure valve is open or the high pressure valve is closed), magnetic flux is directed substantially between the armature and the protrusion and when the armature is moves towards the end stop portion, magnetic flux is directed between the armature and the protrusion with an axial component which increases as the armature moves axially towards the end stop portion.

It may be that the magnetic circuit is configured so that when a current is passed through the solenoid, both the low pressure valve armature and the high pressure valve armature are urged towards the solenoid but that movement of the low pressure valve armature and the high pressure valve armature towards the solenoid opens one of the low pressure valve and the high pressure valve and closes the other of the low pressure valve and the high pressure valve.

It may be that one or more of the magnetic circuit, the low pressure valve armature and the high pressure valve armature comprises a bridge member which directs magnetic flux across an air gap between the magnetic circuit and a respective armature, wherein the bridge member is tapered. It may be that the magnetic circuit passes through at least one said tapered bridging piece, the at least one tapered bridging piece directing magnetic flux across a gap in the magnetic circuit, the at least one tapered bridging piece directing magnetic flux either one or both of a) between a major portion of the magnetic circuit which forms the majority of the magnetic circuit and the low pressure valve armature or the high pressure valve armature and/or b) through a minor portion of the magnetic circuit which extends between the low pressure valve armature and the high pressure valve armature.

The at least one or each bridging member serves to minimize the size of any air gaps and therefore reduce reluctance. Bridging members serve to efficiently transmit flux, to divert flux to an extent by focusing or channeling it as desired, and to transmit flux to adjacent magnetic members. Typically the at least one or each bridge member has a narrow tip. The at least one or each bridge member may have a triangular cross section with a first surface parallel to the direction of movement of the armature and a second surface which meets the first surface at an acute angle such that the thickness of the at least one or each bridging member (of which tapered bridging pieces are an example embodiment), decreases towards its tip. The tapered nature of the at least one or each bridging piece means that field lines are less close together/compressed when the armature is in the energized position. The first parallel surface is located directly adjacent an armature, having a relatively small air gap there-between in order to reduce reluctance between the two parts. This consequently reduces the total reluctance of the entire magnetic circuit. The relatively broad base of the bridging taper pieces is spaced by an air gap apart from the respective armature, and when the armature is in the solenoid energized position, serves to increase the latching force. The latching force retains the armature against the minor portion of the magnetic circuit or an end stop (e.g. to hold the low pressure valve armature in a position such that the low pressure valve is closed or to hold the high pressure valve armature in a position such that the high pressure valve is open).

Thus, the force acting on the respective armature is initially relatively low but increases with displacement of the valve member, as the respective armature moves towards the thicker end of the bridge member, leading to a relatively high mean force acting on the armature and therefore shortening opening or closing times. The use of a triangular cross section, with one surface parallel to the direction of movement of the armature, reduces the need for magnetic flux to pass through air due to the diagonal travel of the magnetic flux/circuit.

It may be that said opening or closing forces are variable responsive to the shared valve actuation signal and the fluid working machine is configured to vary the shared valve actuation signal while said opening or closing forces are applied to thereby vary said opening or closing forces, during at least some operations of said valves. Varying the valve actuation signal may take into account working chamber pressure, and/or low pressure manifold pressure, and/or high pressure manifold pressure.

For example, the opening or closing forces may be a function (for example, proportional to) the current through a shared solenoid or a plurality of solenoids. The fluid working machine may comprise a controller which varies the mean current during actuation. The opening or closing forces may be reduced during actuation after either or both of the low and high pressure valves has opened or closed (as appropriate).

For example, the shared value actuation signal may comprise a first mean current which is applied to cause either or both of the low and high pressure valves to open or close and then a second mean current, which is lower than the first mean current, may be applied. Typically, a greater force is required to open or close a valve than to maintain the valve in the opened or closed position. Thus, energy can be saved by using less current after either or both of the valves have opened or closed (as appropriate). The current may be pulsed and the first and second mean currents may have the same maximum and minimum current values but different mark to space ratios.

This is particularly applicable in embodiments where the electronically controlled valve actuation means comprises at least one solenoid (e.g. a shared solenoid, or a said first solenoid and a said second solenoid) and a magnetic circuit configured to direct magnetic flux through an armature coupled to the low pressure valve member and/or an armature coupled to the high pressure valve member, wherein opening or closing of one or both of the low or high pressure valves responsive to actuation of the solenoid reduces the reluctance of the magnetic circuit due to the movement of either or both said armatures from an initial position to an actuated position. This is because the mean current required to hold said armature or armatures in the actuated position is typically less than the mean current required to move said armature or armatures to the actuated position, due to the low reluctance.

The fluid working machine may be configured to make a step change in the shared valve actuation signal (typically a step change in mean current which functions as the shared valve actuation signal) whilst said opening or closing forces are applied to the low and high pressure valve members.

The electronically controlled valve actuation means may be electronically coupled to one of the low or high pressure valve member to actuate said low or high pressure valve through the other of the low or high pressure valve member.

It may be that the low pressure valve is a face seating valve.

Typically, the low pressure valve or the high pressure valve further comprises a pilot valve comprising a pilot valve member, wherein the electronically controlled valve actuator is also coupled to the pilot valve member to apply an opening or closing force to the pilot valve member responsive to actuation of the electronically controlled valve actuator. The at least one or each pilot valve may have a valve seat, or may be a spool valve, for example.

The opening or closing force applied to the pilot valve member is typically in the same sense as the opening or closing force applied to said valve which further comprises the pilot valve. By a pilot valve we refer to a lower throughput valve which is opened in use before said low pressure valve or high pressure valve to facilitate the opening of said low pressure valve or high pressure valve against a pressure differential. This facilitation by the pilot valve is the removal of the pressure differential across the LPV or HPV, therefore allowing the LPV or HPV to open once the pressure differential has been removed. The pilot valve seat may be integral to the valve member of said low pressure valve or high pressure valve. Pilot valves are disclosed, for example, in EP 2,064,474 (Stein) and EP 2,329,172 (Stein et al.)

A pilot valve is useful in applications with particularly high pressure differentials in use (e.g. off-road vehicles, industrial Hydraulic machinery etc.) and is useful for starting from zero speed shaft, when the high pressure valve is not able to open against pressure differential. The at least one or each pilot valve member may be actuated by the same solenoid as the valve member of the valve which comprises the respective pilot valve.

It may be that the low pressure valve and high pressure valve are integrated into a single unit.

The shared value actuation signal to which the electronically controlled valve actuator means responds may be the presence or absence of a current, voltage or other electrical signal. The electronically controlled valve actuation means may be responsive to the magnitude of the shared valve actuation signal, or its frequency or (in embodiments where the shared valve actuation signal can be pulse width modulated), its mark to space ratio. The electronically controlled valve actuation means may start to apply said opening or closing forces responsive to the shared valve actuation signal and may stop applying said opening or closing forces responsive to a shared valve deactivation signal.

The fluid working machine may be a pump. The fluid working machine may be a motor. The fluid working machine may be a pump-motor which is operable as a pump or a motor in alternative operating modes. The fluid working machine may be pneumatic. The fluid working machine may be hydraulic.

The invention also extends in a second aspect to a method of controlling a low pressure valve and a high pressure valve associated with a working chamber in a fluid working machine according to the first aspect of the invention, wherein the electronically controlled valve actuation means cause an opening or closing force to be applied concurrently to both the low pressure valve member and the high pressure valve member responsive to the shared valve actuation signal and the low pressure valve member and the high pressure valve member move, as a result of the applied forces, at different times.

It may be that the electronically controlled valve actuation means comprises a shared electronically controlled valve actuator which is coupled to both the low pressure valve member and the high pressure valve member.

It may be that the electronically controlled valve actuator applies said opening or closing forces directly to the low pressure valve member and the high pressure valve member.

The electronically controlled valve actuator may cause said opening or closing force to be applied to both the low pressure valve member and the high pressure valve member at the same time and the low pressure valve member and the high pressure valve member moves, responsive to the applied forces, at different times.

Further optional features of the second aspect of the invention correspond to those discussed above in relation to the first aspect.

BRIEF DESCRIPTION OF DRAWINGS

An example embodiment of the invention will now be illustrated with reference to the following Figures:

FIG. 1 is a schematic diagram of a prior art fluid working machine;

FIG. 2 is a schematic diagram of an embodiment of the invention employing a separate actuator for each valve;

FIG. 3 is a schematic diagram of a circuit for actuating the valves in the embodiment of FIG. 2;

FIG. 4 is a schematic diagram of an embodiment of the invention employing a shared electronically controlled valve actuator;

FIG. 5 is a schematic diagram of an embodiment of the invention using coupled pistons;

FIG. 6A is a schematic radial cross section of an embodiment of the invention in which both valve members are driven directly by a single solenoid;

FIG. 6B is a schematic radial cross section of an embodiment of the invention in which both valve members are driven directly by a single solenoid;

FIG. 6C is a schematic radial cross section of an embodiment of the invention in which both valve members are driven directly by a single solenoid;

FIG. 7 is a schematic radial cross section through an alternative example embodiment in which both valve members are driven directly by a single solenoid;

FIG. 8 is a cross-section through an example embodiment in which both valve members are driven directly by a single solenoid;

FIG. 9A is a detail of FIG. 8;

FIG. 9B is a corresponding detail after opening of the high pressure valve;

FIG. 10 illustrates low pressure valve position, a high-pressure valve position, working chamber pressure and the common actuator control signal for both pumping (upper traces) and motoring (lower traces);

FIG. 11A is a schematic radial cross section through an example embodiment in which magnetic flux from a single solenoid is directed through armatures associated with each valve member, either in parallel or in series.

FIG. 11B is a schematic radial cross section through an example embodiment in which magnetic flux from a single solenoid is directed through armatures associated with each valve member, either in parallel or in series.

DESCRIPTION OF EMBODIMENTS

FIG. 1 is a schematic diagram of an individual working chamber 2 in a fluid-working machine 1. The net throughput of fluid is determined by the active control of electronically controllable valves, in phased relationship to cycles of working chamber volume, to regulate fluid communication between individual working chambers of the machine and fluid manifolds. Individual chambers are selectable by a controller, on a cycle by cycle basis, to either displace a predetermined fixed volume of fluid or to undergo an idle cycle with no net displacement of fluid, thereby enabling the net throughput of the pump to be matched dynamically to demand.

An individual working chamber 2 has a volume defined by the interior surface of a cylinder 4 and a piston 6, which is driven from a crankshaft 8 by a crank mechanism 9 and which reciprocates within the cylinder to cyclically vary the volume of the working chamber. A shaft position and speed sensor 10 determines the instantaneous angular position and speed of rotation of the shaft, and transmits shaft position and speed signals to a controller 12, which enables the controller to determine the instantaneous phase of the cycles of each individual working chamber. The controller typically comprises a microprocessor or microcontroller which executes a stored program in use.

The working chamber comprises an actively controlled low pressure valve in the form of an electronically controllable face-sealing poppet valve 14, which faces inwards toward the working chamber and is operable to selectively seal off a channel extending from the working chamber to a low pressure manifold 16. The working chamber further comprises a high pressure valve 18. The high pressure valve faces outwards from the working chamber and is operable to seal off a channel extending from the working chamber to a high pressure manifold 20.

At least the low pressure valve is actively controlled so that the controller can select whether the low pressure valve is actively closed, or in some embodiments, actively held open, during each cycle of working chamber volume. In some embodiments, the high pressure valve is actively controlled and in some embodiments, the high pressure valve is a passively controlled valve, for example, a pressure delivery check valve.

The fluid-working machine may be a pump, which carries out pumping cycles, or a motor which carries out motoring cycles, or a pump-motor which can operate as a pump or a motor in alternative operating modes and can thereby carry out pumping or motoring cycles.

A full stroke pumping cycle is described in EP 0 361 927. During an expansion stoke of a working chamber, the low pressure valve is open and hydraulic fluid is received from the low pressure manifold. At or around bottom dead centre, the controller determines whether or not the low pressure valve should be closed. If the low pressure valve is closed, fluid within the working chamber is pressurized and vented to the high pressure valve during the subsequent contraction phase of working chamber volume, so that a pumping cycle occurs and a volume of fluid is displaced to the high pressure manifold. The low pressure valve then opens again at or shortly after top dead centre. If the low pressure valve remains open, fluid within the working chamber is vented back to the low pressure manifold and an idle cycle occurs, in which there is no net displacement of fluid to the high pressure manifold.

In some embodiments, the low pressure valve will be biased open and will need to be actively closed by the controller if a pumping cycle is selected. In other embodiments, the low pressure valve will be biased closed and will need to be actively held open by the controller if an idle cycle is selected. The high pressure valve may be actively controlled, or may be a passively opening check valve.

A full stroke motoring cycle is described in EP 0 494 236. During a contraction stroke, fluid is vented to the low pressure manifold through the low pressure valve. An idle cycle can be selected by the controller in which case the low pressure valve remains open. However, if a full stroke motoring cycle is selected, the low pressure valve is closed before top dead centre, causing pressure to build up within the working chamber as it continues to reduce in volume. Once sufficient pressure has been built up, the high pressure valve can be opened, typically just after top dead centre, and fluid flows into the working chamber from the high pressure manifold. Shortly before bottom dead centre, the high pressure valve is actively closed, whereupon pressure within the working chamber falls, enabling the low pressure valve to open around or shortly after bottom dead centre.

In some embodiments, the low pressure valve will be biased open and will need to be actively closed by the controller if a motoring cycle is selected. In other embodiments, the low pressure valve will be biased closed and will need to be actively held open by the controller if an idle cycle is selected. The low pressure valve typically opens passively, but it may open under active control to enable the timing of opening to be carefully controlled. Thus, the low pressure valve may be actively opened, or, if it has been actively held open this active holding open may be stopped. The high pressure valve may be actively or passively opened. Typically, the high pressure valve will be actively opened.

In some embodiments, instead of selecting only between idle cycles and full stroke pumping and/or motoring cycles, the fluid-working controller is also operable to vary the precise phasing of valve timings to create partial stroke pumping and/or partial stroke motoring cycles.

In a partial stroke pumping cycle, the low pressure valve is closed later in the exhaust stroke so that only a part of the maximum stroke volume of the working chamber is displaced into the high pressure manifold. Typically, closure of the low pressure valve is delayed until just before top dead centre.

In a partial stroke motoring cycle, the high pressure valve is closed and the low pressure valve opened part way through the expansion stroke so that the volume of fluid received from the high pressure manifold and thus the net displacement of fluid is less than would otherwise be possible.

With reference to FIG. 2, in a first example embodiment, the controller transmits a shared valve actuation signal through a signal output wire 30. The shared valve actuation signal may be a current which is applied to the solenoid of the low and high pressure valves or, for example, a digital signal used to control a circuit which applies a current to the solenoid of the low and high pressure valves responsive to the digital signal. In response to the shared valve actuation signal, current is applied to the solenoids of both the low pressure and high pressure valves, so that they are both energized at the same time, and so the low pressure valve solenoid applies a closing force to the low pressure valve member, and the high pressure valve applies an opening force to the high pressure valve member at the same time. However, because the low and high pressure valve members can move independently, although the low pressure valve member will typically begin to move almost immediately that current is applied to the solenoids, the high pressure valve member will typically not begin to move until the pressure differential across the high pressure valve member, between the working chamber and the high pressure manifold, drops below a threshold.

FIG. 3 illustrates an example of how the low and high pressure valve solenoids 38A, 38B may be driven by the controller. In this example, the controller generates shared valve actuation signals, in digital form, which are processed by an FPGA 32. The FPGA generates a signal which is routed in parallel to a separate FET driver 34A, 34B for each valve. The respective FET drivers each drive an FET 36A, 36B associated with the respective valve, which in turn generate a current which is applied to the respective solenoids. However, one skilled in the art will appreciate that where the control of the low pressure valve and high pressure valve solenoids is split is a matter of design choice. For example a single FET driver might drive two FETs, a single FET might provide a current passed through both the low pressure valve and high pressure valve solenoids, in series or in parallel, and so forth. The control circuit of FIG. 3 and the low and high pressure valve solenoids together function as the electronically controlled valve actuation means.

FIG. 4 is a schematic diagram of a working chamber of a second fluid working machine according to the invention. A shared electronically controlled valve actuator 50 is coupled to the valve members (not shown in FIG. 4) of both the high and low pressure valves. A shared valve actuation signal is transmitted by the controller through control line 52. When the shared valve actuator is actuated, forces are applied to the valve members of the high and low pressure valves to urge the low pressure valve to close and the high pressure valve to open. However, the high and low pressure valve members are able to move independently and, although the low pressure valve member will typically start to move shortly after the shared actuator is actuated, there will be a delay before the high pressure valve member can move, while the pressure in the working chamber increases to a level which enables the high pressure valve to open.

A first example of a shared valve actuator arrangement is illustrated in FIG. 5. A piston 100 is slidably mounted in a master cylinder 102 and driven by a solenoid operated actuator 104. When the solenoid operated actuator is actuated by a shared control signal received through the control line 52, hydraulic fluid is displaced through hydraulic connections 106 to slave cylinders 108, 110 which comprise pistons 112 and 114, which are coupled through valve stems 116, 118 to a low pressure valve member 120 and a high pressure valve member 122 to urge the low pressure valve member towards low pressure valve seat 124 and the high-pressure valve member away from high-pressure valve seat 126. Thus, although actuation of the solenoid operated actuator causes a force to be applied to the low pressure valve member to urge the low pressure valve member towards the low pressure valve seat, and thereby close the low pressure valve, and at the same time causes a force to be applied to the high-pressure valve member to urge the high-pressure valve member away from the high-pressure valve seat, and thereby open the high-pressure valve, the high-pressure valve member can, and in practice does, move at a different time to the low pressure valve member.

With reference to FIG. 6A, in an alternative embodiment a solenoid coil 200 functions as the electronically controlled valve actuator. The solenoid coil is coupled to the low pressure valve member and high pressure valve member (not shown) through a magnetic circuit formed of a first magnetic circuit member 202 (functioning as part of the major portion of the magnetic circuit), and a second magnetic circuit member 204 (functioning as the minor portion of the magnetic circuit) which directs magnetic flux through a low pressure valve armature 206 which is connected to the low pressure valve member (not shown) via a low pressure valve stem 208, and a high pressure valve armature 210 which is connected to the high pressure valve member (not shown) via a high pressure valve stem 212. The low pressure and high pressure valves are configured so that the low pressure valve is closed by axial movement of the low pressure valve armature and valve stem towards the solenoid and the high pressure valve is opened by axial movement of the high pressure valve armature and valve stem towards the solenoid. Although the items labelled 206 in the Figures are the low pressure valve armature and the items labelled 210 are the high pressure valve armature in this example embodiment, the low and high pressure valve armatures could be interchanged in alternative embodiments.

Magnetic circuit members are typically made from steel, and in particular suitable materials include a silicon steel, a silicon core iron, or 430FR which is a ferritic stainless steel.

When current is passed through the solenoid (functioning as the shared valve actuation signal) magnetic flux are directed around the magnetic circuit member and through the low and high pressure valve armatures, in series. As a result, a force acts on both armatures, urging them in an axial direction, towards the solenoid (upwards in FIG. 6A). This applies an opening force to the low pressure valve member and a closing force to the high pressure valve member.

FIGS. 6B and 6C illustrate alternative embodiments which work on a corresponding principle. In the arrangement of FIG. 6C the armatures are urged towards each other. The range of movement of each valve member is governed in one direction by the respective valve seat, and a respective end stop in the other direction. The end stop may engage the valve member, or part of the armature connected to the valve member.

FIG. 7 illustrates a further embodiment which corresponds in general terms to the embodiment of FIG. 6A but the magnetic circuit includes a magnetic connecting portion (functioning as the minor portion of the magnetic circuit) 204, supported by a non-magnetic support member 214 which is adjacent both the low pressure and high pressure valve armatures and includes tapered bridging pieces 216, 217 which have an axial first surface 220 and an angled opposed surface 222. A further bridging piece 218 extends from the magnetic circuit portion adjacent an end stop 224 which defines the maximum axial travel of the high pressure valve armatures towards the solenoid.

The armatures move parallel to the axial first surfaces and as a result of the tapered shape of the bridging pieces, the axial force acting on the valve armatures increases as the armatures move towards their 'activated' positions (the positions towards which they are urged responsive to actuation of the electronically controlled valve actuator). This means that a lower current is required to latch (retain) the valve members in a displaced position when they have completed their movement towards the solenoid and the respective valves are open or closed, than is required to start movement of the valve members. The tapered bridge piece 216 does not change the magnetic force with axial displacement of either armature. Its functions are to help to axially align the HPV armature, to provide additional metal within the magnetic circuit flow path (helping to avoid magnetic saturation), and also to reduce the distance the magnetic flux needs to travel (reduced reluctance).

The taper bridging piece 217 and the further bridging piece 218 provide the proportional control aspect of the magnetic circuit. The 'tip' part of these bridging pieces becomes saturated once the solenoid is activated. Once saturated, flux cannot flow through this portion, and thus flows around the saturated region. Magnetically, the saturated portion equates to an air gap, therefore increasing the tendency for flux to find another path around the saturated portion.

The total length of the bridging pieces, in part determined by the point of truncation, determines the stroke length of each respective armature. The angle of taper of the bridging pieces determines the time to saturation, which can thus be selected. Generally speaking the greater the internal angle between the axial first surface 220 and the angled opposed surface, the longer the time to saturation. The angle of taper of each of the bridging pieces can be manipulated relative to one another in order to change the forces applied to each armature, and thus both the start time, and initial movement characteristics of each armature relative to each other.

FIG. 8 illustrates an integrated valve arrangement 225 based on the general principle of FIGS. 6A and 6B. The integrated valve arrangement comprises both the low pressure and high pressure valves, and a cylinder 226 which slidably receives a piston (not shown) to define a working chamber 227 of cyclically varying volume. Corresponding features have corresponding labelling.

It can be seen that the low pressure valve armature and valve stem 208 are formed integrally with the low pressure valve member 228 and that the low pressure valve moves axially towards the solenoid to close the low pressure valve by bringing the low pressure valve member into sealing contact with the low pressure valve seat 230. The low pressure valve member is biased to the open position by spring 232 and the force from the solenoid reverses the sense of overall biasing.

The high pressure valve member 234 is biased towards high pressure valve seat 236 by spring 237 and actuation of the solenoid reverses the sense of the overall biasing. The integrated high and low pressure valves are held in place in a chassis 238 by an interference fit with oil seals 239 dividing connections to the low and high pressure manifolds 240, 242. A tube of a non-magnetic material 244 (e.g. plastics material, non-magnetic stainless steel, or brass) is also provided around a central core 246 which is part of the magnetic circuit and a further tube of non-magnetic material 248 is provided outside the cylinder to define the magnetic flux path and guide flux through the high pressure valve armature.

FIGS. 9A and 9B illustrate a detail of FIG. 8. The high pressure valve armature is located adjacent a protrusion 250 in a magnetic circuit member such that when the high pressure valve member moves axially, towards the solenoid, from the valve closed position, in which the high pressure valve member has the position illustrated in FIG. 9A to the valve open position, in which the high pressure valve member has the position illustrated in FIG. 9B, the reluctance of a magnetic circuit path 252 through the protrusion and the high pressure valve member is increased, to maximise the passage of flux through magnetic circuit path 254, reducing the total current and therefore power consumption required to hold the high pressure valve member open against a given pressure differential.

Layout 7A initially allows lots of flux to enter and exit the HPV armature in a radial direction with low reluctance so that good force can be generated on the LPV. When the LPV shuts and a partial stroke pumping cycle occurs to equalise pressure, this pressure pulse helps HPV armature move upwards (alternatively the radial flux path can be made thin enough to start saturating after which some flux is forced to enter or leave axially generating an axial up force). After it has started to move, the flux path radially across the HPV armature, gets cut off (due to the 'protrusion' 250, the radial flux path reduces in area as armature moves upwards) and flux is forced to flow axially and generates an axial upforce. Once it is in the latching position the flux flow enters and or exits the armature in an axial direction generating a strong latching force and current can then be dropped to give efficient latching.

FIG. 10 shows the variation in low pressure valve position 300A, high pressure valve position 302A, the value of a shared control signal (e.g. the current through a solenoid) 304A and working chamber pressure 306A (which is illustrated relative to the low pressure manifold pressure 308) during a pumping cycle, as well as the variation in low pressure valve position 300B, high pressure valve position 302B the value of a shared control signal (e.g. the current through a solenoid) 304B and working chamber pressure 306B during a motoring cycle. The timing of events is shown relative to cycles of working chamber volume 310 between the point of maximum volume, bottom dead centre (BDC) and point of minimum volume, top dead centre (TDC) and is applicable to the valves illustrated in FIGS. 6A, 6B, 6C, 7 and 8.

During a pumping cycle, shortly before bottom dead centre a current (functioning as the shared control signal) is passed through the solenoid (functioning as the shared actuator). As a result, a closing force is applied to the low pressure valve member and an opening force is applied to the high pressure valve member. In each case, the force from the armature exceeds the biasing force from the respective spring, changing the sense of the net biasing on the respective valve members. The low pressure valve begins to open straight away, leading to an active pumping cycle (if in the alternative no signal is sent, the low pressure valve remains open and an idle cycle takes place). Pressure in the working chamber rises as the working chamber contracts whilst sealed and the high pressure valve opens once the pressure differential between the working chamber and the high pressure manifold is sufficiently low that the net force urging the high pressure valve open exceeds the forces urging the high pressure valve closed arising from the pressure differential across the high pressure valve member. Once the high pressure valve has opened, the force from the solenoid is generally not further required and the current can be switched off.

The high pressure valve closes passively when the piston reaches top dead centre and the working chamber begins to expand again. The low pressure valve then opens once the pressure within the working chamber is sufficiently close to the low pressure manifold that the spring biasing the low pressure valve can overcome the force due to the pressure differential across the low pressure valve member.

During a motoring cycle, a current is applied to the solenoid shortly before top dead centre. This causes the low pressure valve to immediately close, however, the high pressure valve cannot immediately open due to the pressure differential between the working chamber and the high pressure manifold. However, once the working chamber is sealed, the pressure rises rapidly until the high pressure valve opens. Once the high pressure valve has opened, the average solenoid current which is required to maintain the low pressure valve in the closed position and high pressure valve in the open position is reduced, and so the average current through the solenoid is reduced, by using pulse wave modulation, and reducing the mark to space ratio of the current pulses as far as possible. This reduces overall energy consumption. Thus, there is a step change decrease 312 in the mean current through the solenoid, once the low pressure valve is closed and the high pressure valve has opened.

As well as an arrangement in which magnetic flux are directed through the low pressure and high pressure valve armature is in the series, it is also possible for a single solenoid to apply forces to both armatures by directing magnetic flux through them in parallel. This is illustrated in FIGS. 11A and 11B, where magnetic circuit member 202 directs flux through both low pressure valve armature 206 and high pressure valve armature 210 at the same time. The arrangement illustrated in FIG. 11B, in which there is a significant gap 260 between the magnetic circuit members and each armature is preferable as this reduces the extent to which the movement of one of the armatures until it has seated against the core 246 decreases the reluctance of the magnetic circuit path through the armature which has moved, reducing the force applied to the armature which has not yet moved.

Thus, the invention has provided a mechanism which is compact and which requires only a single control signal to enable both the low and high pressure valves to be actively controlled, to enable the hydraulic machine to select between active and inactive cycles. This reduces wiring requirements and simplifies control.

In some embodiments, the timing of the single shared control signal relative to cycles of working chamber volume enables the controller to select between active pumping and motoring cycles. The timing of the single shared control signal relative to cycles of working chamber volume (the phasing) can be varied to determine the precise fraction of maximum working chamber volume which his displaced during each active cycle.

Once the low and high pressure valve members have moved, the force which is required to hold them (in the closed position in the case of the low pressure valve and the open position in the case of the high pressure valve member) is reduced and, particularly during motoring cycles, power consumption can be reduced, for example, by reducing the average current through the solenoid, thereby increasing overall efficiency of the machine.

Further variations and modifications may be made within the scope of the invention herein disclosed.

REFERENCE SIGNS LIST

1 Fluid-working machine
2 Working chamber
4 Cylinder
6 Piston
8 Crankshaft
9 Crank mechanism
10 Shaft position and speed sensor
12 Controller
14 Low pressure valve
16 Low pressure manifold
18 High pressure valve
20 High pressure manifold
30 Signal output wire
32 FPGA
34A, 34B FET drivers
36A, 36B FETs
30A, 30B High pressure valve solenoids
50 Shared electronically controlled valve actuator
52 Control line
100 Piston
102 Master cylinder
104 Solenoid operated actuator
105 Hydraulic connections
108, 110 Slave cylinders
112, 114 Pistons
116, 118 Valve Stems
120 Low pressure valve member
122 High pressure valve member
124 Low pressure valve seat
126 High pressure valve seat
200 Solenoid coil
202 Major portion of magnetic circuit (first magnetic circuit portion)
204 Minor portion of magnetic circuit (second magnetic circuit portion)
206 Low pressure valve armature

208 Low pressure valve stem
210 High pressure valve armature
212 High pressure valve stem
214 Non-magnetic support
216, 217 Tapered bridging pieces
218 Further bridging piece
220 First surface
222 Opposed surface
224 End stop
225 Integrated valve arrangement
226 Cylinder
227 Working chamber
228 Low pressure valve member
230 Low pressure valve seat
232 Spring
234 High pressure valve member
236 High pressure valve seat
237 Spring
238 Chassis
239 Oil seals
240 Low pressure manifold
242 High pressure manifold
244 Tube of non-magnetic material
246 Central core
248 Tube of non-magnetic material
250 Protrusion
252 Magnetic circuit path
254 Magnetic circuit path
260 Gap
300A Low pressure valve position during pumping cycle
300B Low pressure valve position during motoring cycle
302A High pressure valve position during pumping cycle
302B High pressure valve position during motoring cycle
304A Shared control signal during pumping cycle
304B Shared control signal during motoring cycle
306A Working chamber pressure during pumping cycle
306B Working chamber pressure during motoring cycle
308 Low pressure manifold pressure
310 Working chamber volume

The invention claimed is:

1. A fluid working machine comprising at least one working chamber of cyclically varying volume, a low pressure fluid line, a high pressure fluid line, a low pressure valve for regulating a flow of fluid between the working chamber and the low pressure fluid line, a high pressure valve for regulating the flow of fluid between the working chamber and the high pressure fluid line, the low and high pressure valves being selectively actuatable on each cycle of working chamber volume to determine a net displacement of working fluid by the working chamber, the low pressure valve comprising a low pressure valve member, the high pressure valve comprising a high pressure valve member, the low pressure valve member and the high pressure valve member, being independently movable between open and closed positions, wherein the fluid working machine further comprises an electronically controlled valve actuation unit configured to both cause an opening or closing force to be applied to the low pressure valve member and to cause an opening or closing force to be applied to the high pressure valve member responsive to a shared valve actuation signal so that the movement of one of the low pressure valve member and the high pressure valve member to the closed position begins before the movement of the other of the low pressure valve member and the high pressure valve member to the open position, wherein the electronically controlled valve actuation unit comprises a shared electronically controlled valve actuator coupled to both the low pressure valve member and the high pressure valve member and configured to cause both the opening or closing force to be applied to the low pressure valve member and to cause the opening or closing force to be applied to the high pressure valve member responsive to the shared valve actuation signal, wherein the shared electronically controlled valve actuator comprises a solenoid coil, wherein the low pressure valve member and the high pressure valve member are each mechanically coupled to a respective armature, and wherein both the armatures are electronically driven by the same solenoid coil.

2. A fluid working machine according to claim 1, wherein the electronically controlled valve actuation unit causes said opening or closing forces to be applied to the low pressure valve member and the high pressure valve member concurrently but the low pressure valve member and the high pressure valve member open or close at different times in dependence on changes in the pressure in the working chamber and the low and high pressure fluid lines respectively.

3. A fluid working machine according to claim 1, wherein the low pressure valve comprises a low pressure valve biasing member which biases the low pressure valve member to the open position, the high pressure valve comprises a high pressure valve biasing member which biases the high pressure valve member to the closed position, and the forces caused by the electronically controlled valve actuation unit oppose the biasing forces of the low pressure and high pressure valve biasing members.

4. A fluid working machine according to claim 1, wherein the low pressure valve member is biased either to the open position or the closed position by one or more low pressure valve biasing members and the high pressure valve member is biased either to the open position or the closed position by one or more high pressure valve biasing members and said opening or closing forces caused by the electronically controlled valve actuation unit oppose and exceed the net biasing forces applied to the low pressure and high pressure valve members by the one or more low pressure and high pressure valve biasing members.

5. A fluid working machine according to claim 1, wherein the electronically controlled valve actuator comprises an armature which is moved when the electronically controlled valve actuator is actuated and the forces applied to the low pressure valve member and the high pressure valve member are coupled to movement of the armature.

6. A fluid working machine according to claim 1, further comprising a magnetic circuit extending through the solenoid coil and configured to direct magnetic flux through both armatures.

7. A fluid working machine, comprising at least one working chamber of cyclically varying volume, a low pressure fluid line, a high pressure fluid line, a low pressure valve for regulating a flow of fluid between the working chamber and the low pressure fluid line, a high pressure valve for regulating the flow of fluid between the working chamber and the high pressure fluid line, the low and high pressure valves being selectively actuatable on each cycle of working chamber volume to determine a net displacement of working fluid by the working chamber, the low pressure valve comprising a low pressure valve member, the high pressure valve comprising a high pressure valve member, the low pressure valve member and the high pressure valve member being independently movable between open and closed positions, wherein the fluid working machine further comprises an electronically controlled valve actuation unit configured to both cause an opening or closing force to be applied to the low pressure valve member and to cause an opening or closing force to be applied to the high pressure valve member responsive to a shared value actuation signal, wherein the electronically controlled valve actuation unit comprises a shared electronically controlled valve actuator coupled to both the low pressure valve member and the high pressure valve member and configured to cause both the opening or closing force to be applied to the low pressure valve member and to cause the opening or closing force to be applied to the high pressure valve member responsive to the shared valve actuation signal, wherein the shared electronically controlled valve actuator comprises a solenoid coil, wherein the low pressure valve member and the high pressure valve member are each mechanically coupled to a respective armature, wherein both the armatures are electronically driven by the same solenoid coil, wherein the fluid working machine comprises a magnetic circuit extending through the solenoid coil, and wherein the magnetic circuit is configured to direct magnetic flux through both armatures in series.

8. A fluid working machine according to claim 1, wherein said opening or closing forces are variable responsive to a valve actuation signal and the fluid working machine is configured to vary the valve actuation signal while said opening or closing forces are applied to thereby vary said opening or closing forces with the low pressure valve member and the high pressure valve member maintained in the open position or the closed position, during at least some operations of said valves.

9. A fluid working machine according to claim 8, wherein the fluid working machine is configured to make a step change in the valve actuation signal with the low pressure valve member and the high pressure valve member maintained in the open position or the closed position whilst said opening or closing forces are applied to the low and high pressure valve members.

10. A fluid working machine according to claim 1, wherein the low pressure valve is a face seating valve.

11. A fluid working machine according to claim 1, wherein the high pressure valve is a face seating valve.

12. A fluid working machine according to claim 1, wherein the low pressure valve or the high pressure valve further comprises a pilot valve having a pilot valve seat, wherein the electronically controlled valve actuation unit is also coupled to the pilot valve member to apply an opening or closing force to the pilot valve responsive to actuation of the electronically controlled valve actuator.

13. A fluid working machine according to claim 1, wherein the low pressure valve and high pressure valve are integrated into a single unit.

14. A method of controlling a fluid working machine according to claim 1, wherein the electronically controlled valve actuation unit causes the opening or closing force to be applied concurrently to both the low pressure valve member and the high pressure valve member responsive to the shared value actuation signal and the low pressure valve member and the high pressure valve member move, as a result of the applied forces, at different times.

15. A fluid working machine, comprising at least one working chamber of cyclically varying volume, a low pressure fluid line, a high pressure fluid line, a low pressure valve for regulating a flow of fluid between the working chamber and the low pressure fluid line, a high pressure valve for regulating the flow of fluid between the working chamber and the high pressure fluid line, the low and high pressure valves being selectively actuatable on each cycle of working chamber volume to determine a net displacement of working fluid by the working chamber, the low pressure valve comprising a low pressure valve member, the high pressure valve comprising a high pressure valve member, the low pressure valve member and the high pressure valve member being independently movable between open and closed positions, wherein the fluid working machine further comprises an electronically controlled valve actuation unit configured to both cause an opening or closing force to be applied to the low pressure valve member and to cause an opening or closing force to be applied to the high pressure valve member responsive to a shared value actuation signal, wherein the electronically controlled valve actuation unit comprises a shared electronically controlled valve actuator coupled to both the low pressure valve member and the high pressure valve member and configured to cause both the opening or closing force to be applied to the low pressure valve member and to cause the opening or closing force to be applied to the high pressure valve member responsive to the shared valve actuation signal, wherein the shared electronically controlled valve actuator comprises a solenoid coil, wherein the low pressure valve member and the high pressure valve member are each mechanically coupled to a respective armature, wherein both the armatures are electronically driven by the same solenoid coil, wherein the fluid working machine comprises a magnetic circuit extending through the solenoid coil and configured to direct magnetic flux through both armatures, and wherein the fluid working machine further comprises a magnetic connecting portion disposed adjacent both the low pressure and high pressure valve armatures, the magnetic connecting portion including tapered bridging pieces at both sides in a travel direction of the low pressure and high pressure valve armatures.

16. A fluid working machine according to claim 15, further comprising a non-magnetic support member supporting the magnetic connecting portion.

17. A fluid working machine, comprising at least one working chamber of cyclically varying volume, a low pressure fluid line, a high pressure fluid line, a low pressure valve for regulating a flow of fluid between the working chamber and the low pressure fluid line, a high pressure valve for regulating the flow of fluid between the working chamber and the high pressure fluid line, the low and high pressure valves being selectively actuatable on each cycle of working chamber volume to determine a net displacement of working fluid by the working chamber, the low pressure valve comprising a low pressure valve member, the high pressure valve comprising a high pressure valve member, the low pressure valve member and the high pressure valve member being independently movable between open and closed positions, wherein the fluid working machine further comprises an electronically controlled valve actuation unit configured to both cause an opening or closing force to be applied to the low pressure valve member and to cause an opening or closing force to be applied to the high pressure valve member responsive to a shared value actuation signal, wherein the electronically controlled valve actuation unit comprises a shared electronically controlled valve actuator coupled to both the low pressure valve member and the high pressure valve member and configured to cause both the opening or closing force to be applied to the low pressure valve member and to cause the opening or closing force to be applied to the high pressure valve member responsive to the shared valve actuation signal, wherein the shared electronically controlled valve actuator comprises a solenoid coil, wherein the low pressure valve member and the high pressure valve member are each mechanically coupled to a respective armature, wherein both the armatures are electronically driven by the same solenoid coil, wherein the fluid working machine comprises a magnetic circuit extending through the solenoid coil and configured to direct magnetic flux through both armatures, and wherein the fluid working machine further comprises an end stop which defines a maximal axial travel of the low pressure or high pressure valve armatures, and a tapered bridging piece disposed adjacent the end stop.

* * * * *